United States Patent [19]

Piedrahita et al.

[11] Patent Number: 5,037,533

[45] Date of Patent: Aug. 6, 1991

[54] ORE FLOTATION PROCESS AND USE OF PHOSPHORUS CONTAINING SULFO COMPOUNDS

[75] Inventors: Carlos A. Piedrahita, Mentor; Edward P. Richards, Chagrin Falls, both of Ohio

[73] Assignee: The Lubrizol Corporation, Wickliffe, Ohio

[21] Appl. No.: 480,438

[22] Filed: Feb. 15, 1990

[51] Int. Cl.[5] ..... B03D 1/014; B03D 1/018; B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 30,142 | 11/1979 | LeSuer | 252/46.7 |
| 2,512,715 | 6/1950 | Carvajal | 209/166 |
| 2,965,665 | 12/1960 | Gaertner | 209/166 |
| 3,223,238 | 12/1965 | Bikales | 209/166 |
| 4,026,812 | 5/1977 | LeSuer | 252/75 |
| 4,879,022 | 11/1989 | Clark et al. | 209/166 |

OTHER PUBLICATIONS

AMPS® Monomer Product Brochure, The Lubrizol Corporation, 1988.

*Primary Examiner*—Stanley Silverman
*Assistant Examiner*—Thomas M. Lithgow
*Attorney, Agent, or Firm*—Robert A. Franks; Forrest L. Collins; Frederick D. Hunter

[57] ABSTRACT

The present invention relates to an improved process for beneficiating an ore containing sulfide materials with selective rejection of pyrite, pyrrhotite and other minerals and gangue. In particular, the process is useful for beneficiating ores and recovering metals such as copper, lead, zinc, etc., from said ores. In one embodiment the process comprises the steps of:

(A) forming a slurry of at least one crushed mineral-containing ore, water and at least one collector which is an acid, or an anhydride, ester, ammonium salt or metal salt of the acid that is represented by the formula

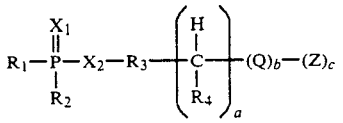

(I)

or

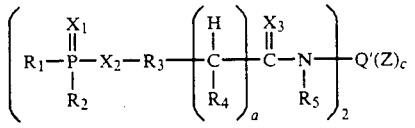

(II)

wherein each $R_1$ and $R_2$ is independently a hydrocarbyl or hydrocarbyloxy or hydrocarbylthio group;

each $X_1$ and $X_2$ is independently sulfur or oxygen;

$R_3$ is a divalent hydrocarbyl group, hydrogen or hydrocarbyl group;

a is 0 or 1;

b is 0 or 1;

c is 1 or 2;

Q is a divalent, trivalent or tetravalent hydrocarbyl group or $—C(X_3)NR_5Q'$;

$X_3$ is sulfur or oxygen;

Q' is a divalent, trivalent or tetravalent hydrocarbyl group provided Q' is not divalent in Formula II;

Z is —S(O)OH, or $—S(O)_2OH$.

(B) subjecting the slurry from step (A) to froth flotation to produce a froth; and (C) recovering a mineral from the froth.

33 Claims, No Drawings

ORE FLOTATION PROCESS AND USE OF PHOSPHORUS CONTAINING SULFO COMPOUNDS

TECHNICAL FIELD OF THE INVENTION

This invention relates to froth flotation processes for the recovery of metal values from metal sulfide ores. More particularly, it relates to the use of improved collectors for beneficiating mineral values comprising phosphorus-containing sulfonic acids or salts.

BACKGROUND OF THE INVENTION

Froth flotation is one of the most widely used processes for beneficiating ores containing valuable minerals. It is especially useful for separating finely ground valuable minerals from their associated gangue or for separating valuable minerals from one another. The process is based on the affinity of suitably prepared mineral surfaces for air bubbles. In froth flotation, a froth or a foam is formed by introducing air into an agitated pulp of the finely ground ore in water containing a frothing or foaming agent. A main advantage of separation by froth flotation is that it is a relatively efficient operation at a substantially lower cost than many other processes.

It is common practice to include in the flotation process, one or more reagents called collectors or promoters that impart selective hydrophobicity to the valuable mineral that is to be separated from the other minerals. It has been suggested that the flotation separation of one mineral species from another depends upon the relative wettability of mineral surfaces by water. Many types of compounds have been suggested and used as collectors in froth flotation processes for the recovery of metal values. Examples of such types of collectors include the xanthates, xanthate esters, dithiophosphates, dithiocarbamates, trithiocarbonates, mercaptans and thionocarbonates. Xanthates and dithiophosphates have been employed extensively as sulfide collectors in froth flotation of base metal sulfide ores.

Dialkyldithiophosphoric acids and salts thereof such as the sodium, potassium, calcium or ammonium salts have been utilized as promoters or collectors in the beneficiation of mineral-bearing ores by flotation for many years. Early references to these compounds and their use as flotation promoters may be found in, for example, U.S. Pat. Nos. 1,593,232 and 2,038,400. Ammonium salt solutions of the dithiophosphoric acids are disclosed as useful in U.S. Pat. No. 2,206,284, and hydrolyzed compounds are disclosed as useful in U.S. Pat. No. 2,919,025.

The dialkyldithiophosphoric acids utilized as flotation promoters and collectors for sulfide and precious metal ores are obtained by reacting an alcohol with phosphorus and sulfur generally as $P_2S_5$. The acid obtained in this manner can then be neutralized to form a salt.

U.S. Pat. No. 3,086,653 describes aqueous solutions of alkali and alkaline earth metal salts of phospho-organic compounds useful as promoters or collectors in froth flotation of sulfide ores. The phospho-organic compounds are neutralized $P_2S_5$-alkanol reaction products. Although single alcohols are normally used in the reaction, the patentees disclose that mixtures of isomers of the same alcohol, and mixtures of different alcohols may be utilized as starting materials in the preparation of the phosphorus compound, and the resulting acidic products can be readily neutralized to form stable solutions which are useful as flotation agents.

U.S. Pat. No. 3,570,772 describes the use of di(4,5-carbon branched primary alkyl) dithiophosphate promoters for the flotation of copper middlings. The 4 and 5 carbon alcohols used as starting materials may be either single alcohols or mixtures of alcohols.

Procedures for the selective flotation of copper minerals from copper sulfide ores wherein a slurry of ore and water is prepared and sulfurous acid is added to the slurry to condition the slurry prior to the froth flotation step have been discussed in, for example, U.S. Pat. Nos. 4,283,017 and 4,460,459. Generally, the pulp is conditioned with sulfur dioxide as sulfurous acid under intense aeration.

SUMMARY OF THE INVENTION

The present invention relates to an improved process for beneficiating an ore containing sulfide materials with selective rejection of pyrite, pyrrhotite and other minerals and gangue. In particular, the process is useful for beneficiating ores and recovering metals such as copper, lead, zinc, etc., from said ores. In one embodiment the process comprises the steps of (A) forming a slurry of at least one crushed mineral-containing ore, water and at least one collector which is an acid, or an anhydride, ester, ammonium salt or metal salt of the acid that is represented by one of the formulae

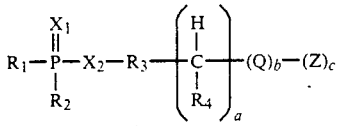

(I)

or

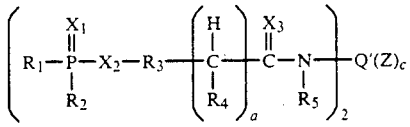

(II)

wherein each $R_1$ and $R_2$ is independently a hydrocarbyl or hydrocarbyloxy or hydrocarbylthio group;

each $X_1$ and $X_2$ is independently sulfur or oxygen;

$R_3$ is a divalent hydrocarbyl group, each $R_4$ and $R_5$ is independently a hydrogen or hydrocarbyl group;

a is 0 or 1;

b is 0 or 1;

c is 1 or 2;

Q is a divalent, trivalent or tetravalent hydrocarbyl group of $—C(X_3)NR_5Q'$;

$X_3$ is sulfur or oxygen;

Q' is a divalent, trivalent or tetravalent hydrocarbyl group provided Q' is not divalent in Formula II;

Z is —S(O)OH, or $—S(O)_2OH$.

(B) subjecting the slurry from step (A) to froth flotation to produce a froth; and (C) recovering a mineral from the froth.

DETAILED DESCRIPTION OF THE INVENTION

In the specification and claims, the term alkylene is meant to refer to a divalent hydrocarbon group, such as methylene, ethylene, and like groups.

The froth flotation process of the present invention is useful to beneficiate sulfide mineral and metal values from sulfide ores including, for example, copper, lead, zinc, nickel, and cobalt. Lead can be beneficiated from minerals such as galena (PbS) and zinc can be beneficiated from minerals such as sphalerite (ZnS). Cobalt-nickel sulfide ores such as siegenite or linnalite can be beneficiated in accordance with this invention. The copper sulfide minerals which can be beneficiated in accordance with this invention are primarily chalcopyrites ($CuFeS_2$) and copper-containing minerals commonly associated therewith. The invention is useful particularly in beneficiating the complex copper sulfide minerals such as obtained from the Southwest of the United States of America. The complex sulfide ores contain large amounts of pyrite, (and other iron sulfides) which generally are relatively difficult to separate the desired minerals.

In the following description of the invention, however, comments primarily will be directed toward the beneficiation and recovery of copper minerals, and it is intended that such discussion shall also apply to the other above-identified minerals. The process of the present invention has been found to be particularly useful in beneficiating complex copper sulfide ores such as the porphyry copper-molybdenum ores of the Southwest of the United States of America.

The ores which are treated in accordance with the process of the present invention must be reduced in particle size to provide ore particles of flotation size. As is apparent to those skilled in the art, the particle size to which an ore must be reduced in order to liberate mineral values from associated gangue and non-value metals will vary from ore to ore and depends upon several factors, such as, for example, the geometry of the mineral deposits within the ore, e.g., striations, agglomerations, etc. Generally, suitable particle sizes are minus 10 mesh (1000 microns) (Tyler) with 50% or more passing 200 mesh (70 microns). The size reduction of the ores may be performed in accordance with any method known to those skilled in the art. For example, the ore can be crushed to about minus 10 mesh (1000 microns) size followed by wet grinding in a steel ball mill to specified mesh size ranges. Alternatively, pebble milling may be used. The procedure used in reducing the particle size of the ore is not critical to the method of this invention so long as particles of effective flotation size are provided.

Water is added to the grinding mill to facilitate the size reduction and to provide an aqueous pulp or slurry. The amount of water contained in the grinding mill be varied depending on the desired solid content of the pulp or slurry obtained from the grinding mill. Conditioning agents as known in the art may be added to the grinding mill prior to or during the grinding of crude ore. Optionally, water-soluble inorganic bases and/or collectors also may be included in the grinding mill.

At least one collector of the present invention is added to the grinding mill to form the aqueous slurry or pulp. The collector may be added prior to or during grinding of the crude ore. The collectors useful in the present invention are those described in the summary and below.

In Formulae I and II, preferably each $R_1$ and $R_2$ is independently hydrocarbyl or hydrocarbyloxy containing from 1 to about 30 carbon atoms. In one embodiment preferably each $R_1$ and $R_2$ is independently alkoxy groups having from about 2 to about 24 carbon atoms, more preferably about 2 to about 12, more preferably from about 3 to about 6. In another embodiment, each $R_1$ and $R_2$ is independently alkoxy groups having from 4 to 5 carbon atoms. In another embodiment each $R_1$ and $R_2$ is independently aryloxy having from 6 to about 30 carbon atoms, more preferably 6 to about 24, more preferably from 6 to about 12. It should also be noted that each $R_1$ and $R_2$ may be independently alkoxy or aryloxy.

In Formulae I and II, each $X_1$, $X_2$ and $X_3$ is independently sulfur or oxygen. $X_1$ and $X_2$ are preferably sulfur and $X_3$ is preferably oxygen.

In Formulae I and II, each $R_4$ and $R_5$ is independently hydrogen or hydrocarbyl. In one embodiment, each $R_4$ and $R_5$ is independently a hydrogen or an alkyl group having from 1 to 12 carbon atoms, preferably from 1 to about 6, more preferably 1 to about 4. In a preferred embodiment each $R_4$ and $R_5$ is independently hydrogen, methyl, ethyl, propyl or butyl.

In Formulae I and II, each Q and Q' is independently a divalent, trivalent or tetravalent hydrocarbyl group except that Q' is not divalent in Formula II. Preferably, each Q and Q' is independently selected from the group consisting of alkylene, arylene, alkylarylene, arylalkylene with alkylene more preferred. Q and Q' contain from 1 to about 24 carbon atoms except when Q and Q' are arylene, where they contain from 6 to about 24 carbon atoms. Preferred ranges for Q and Q' are 1 to about 18, more preferably 1 to 12 carbon atoms. When Q and Q' are arylene, the preferred size of the group is from 6 to about 18 carbon atoms, with 6 to about 12 carbon atoms being more preferred. Q is preferably alkylene or $-C(X_3)NR_5Q'$, with $-C(X_3)NR_5Q'$ being more preferred.

Examples of divalent hydrocarbyl groups for Q and Q' include, but are not limited to, methylene, ethylene, propylene, butylene, octylene, decylene, tolylene, naphthylene, cyclohexylene, cyclopentylene, dimethylethylene, diethylethylene, butylpropylethylene and the like. When Q and Q' are trivalent hydrocarbyl groups, the groupings are the same except that a hydrogen atom is removed from the above list. For instance, when a hydrogen atom is removed from ethylene, the group becomes ethylidyne, and so forth.

The collector may be prepared by the reaction of a phosphorus acid as represented by the following formula

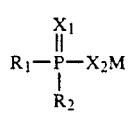

wherein $R_1$, $R_2$, $X_1$ and $X_2$ are as defined above; and M is a hydrogen or an alkali, alkaline earth or transition metal.

The phosphorus acids useful in the present invention are phosphoric; phosphonic; phosphinic; thiophosphoric; including dithiophosphoric as well as monothiophosphoric, thiophosphinic or thiophosphonic acids. The use of the term thiophosphoric, thiophosphonic or thiophosphinic acids is also meant to encompass monothio as well as dithio derivatives of these acids. In one embodiment of the present invention, the phosphorus acid compound is a dithiophosphoric acid. The dithiophosphoric acids of particular interest are 0,0-dihydrocarbylphosphorodithioic acids also known as dihydrocarbyldithiophosphoric acids. The dihydrocarbylphosphorodithioic acids may have hydrocarbyl groups which are the same or different. Dihydrocarbyldithiophosphoric acids include diaryldithiophosphoric acids and dialkyldithiophosphoric acids. Examples of aryl groups on the dithiophosphoric acid include: phenyl, heptylphenyl, nonylphenyl, cresyl, naphthenyl or mixtures of two or more thereof. Examples of alkyl groups on a dithiophosphoric acid include: dipropyl, dibutyl, dipentyl, dihexyl, dioctyl, etc. The dithiophosphoric acids may also contain a mixture of alkyl groups. Specific examples of mixed alkyl groups on the dialkyldithiophosphoric acids include: methyl, butyl; propyl, butyl; amyl, butyl; hexyl, butyl; pentyl, octyl; hexyl, decyl; and octyl, dodecyl. The above terms for the alkyl groups are meant to encompass all isomeric arrangements of the above. For instance, amyl is meant to encompass primary, secondary and tertiary amyl alkyl groups.

The dithiophosphoric acids may also be a mixture of alkyl and aryl groups. These acids may be any two of the groups from the above lists of alkyl and aryl groups. Examples of mixed groups include heptylphenol, butyl; phenyl, amyl; cresyl, propyl and the like.

The dihydrocarbyl phosphorodithioic acids may be prepared by reaction of alcohols with $P_2S_5$ between the temperature of about 50° C. to about 150° C. Often the alcohols, phenols or mixtures thereof are reacted with $P_2S_5$ to form the dithiophosphoric acids. Preparation of dithiophosphoric acids and their salts is well known to those of ordinary skill in the art.

The phosphorus acid compounds previously described are reacted with sulfo compounds of the general formulae:

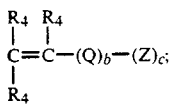

(III)

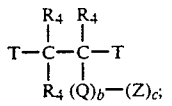

(IV)

wherein $R_4$, b, c, Q and Z are as defined previously. T is hydrogen or a halogen atom provided that only one T is a halogen. T is preferably chlorine, bromine or iodine, with chlorine being the more preferred.

The above described sulfo compounds may be reacted with the phosphorus acids or salts at a temperature from about 25° C. to about 250° C., preferably about 50° C. to about 150° C.

Useful sulfo compounds are sulfonic acid containing compounds. Sulfonic acid containing compounds useful in the present invention include vinyl alkyl sulfonic acids, halosulfonic acids, and vinyl aromatic sulfonic acids. Examples of useful sulfonic acid compounds encompassed by formula III are vinyl sulfonic acid, vinyl naphthalene sulfonic acid, vinyl anthracene sulfonic acid, vinyl toluene sulfonic acid, methallylsulfonic acid (2-methyl-2-propene-1-sulfonic acid) and acrylamidohydrocarbyl sulfonic acid. Examples of compounds encompassed by formula IV are chlorobutyl sulfonic acid, chloropropane sulfonic acid and chloroethane sulfonic acid.

A particularly useful acrylamidohydrocarbyl sulfonic acid is 2-acrylamido-2-methylpropane sulfonic acid. This compound is available from The Lubrizol Corporation, Wickliffe, Ohio, USA under the trademark AMPS® Monomer. Other useful sulfo compounds include: 2-acrylamidoethane sulfonic acid, 2-acrylamidopropane sulfonic acid, 3-methylacrylamidopropane sulfonic acid, 1,1-bis(acrylamido)-2-methylpropane-2-sulfonic acid, and the like.

The reaction of the phosphorus acid and the sulfo compound may occur between a phosphorus acid and a sulfo acid as well as the anhydride, ester, ammonium salt or metal salt of the sulfo acid.

When the collector is an ester, the ester is formed from any one of the acids represented in Formula I, II, III or IV. The ester may be formed by one of the above acids reacting with (1) a trialkylphosphate; (2) sulfur trioxide and an alcohol; (3) dialkylsulfate in dimethylformamide; (4) silver oxide and alkyl halide; and (5) alkylene oxide. The reactions described above are known to those in the art.

The preparation of esters of amido alkane sulfonic acid are described in U.S. Pat. Nos. 3,937,721; 3,956,354; 3,960,918; and German Patent 2,420,738.

Preferred esters are those having from 1 to about 40, preferably from 1 to about 20, more preferably from 1 to about 10, more preferably from 1 to about 6 carbon atoms in the ester group. Methyl esters are preferred.

When the collector is an ammonium salt, the ammonia salt may be prepared from ammonia, a monoamine or a polyamine.

The monoamines generally contain from 1 to about 24 carbon atoms, with 1 to about 12 carbon atoms being more preferred, with 1 to about 6 being more preferred. Examples of monoamines useful in the present invention include methylamine, ethylamine, propylamine, butylamine, octylamine, and dodecylamine. Examples of secondary amines include dimethylamine, diethylamine, dipropylamine, dibutylamine, methylbutylamine, ethylhexylamine, etc. Tertiary amine include trimethylamine, tributylamine, methyldiethylamine, ethyldibutylamine, etc.

In another embodiment the amines are hydroxyamines. Typically, the hydroxyamines are primary, secondary or tertiary alkanol amines or mixtures thereof. Such amines can be represented by the formulae:

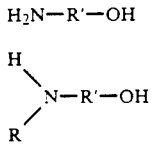

and

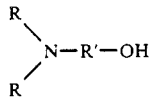

wherein each R is independently a hydrocarbyl group of one to about eight carbon atoms or hydroxyhydrocarbyl group of two to about eight carbon atoms and R′ is a divalent hydrocarbyl group of about two to about 18 carbon atoms. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. Where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thio morpholines, -piperidines, -oxazolidines, -thiazolidines and the like. Typically, however, each R is a lower alkyl group of up to seven carbon atoms.

The hydroxyamines can also be an ether N-(hydroxyhydrocarbyl)amine. These are hydroxypoly(hydrocarbyloxy) analogs of the above-described hydroxyamines (these analogs also include hydroxyl-substituted oxyalkylene analogs). Such N-(hydroxyhydrocarbyl) amines can be conveniently prepared by reaction of epoxides with aforedescribed amines and can be represented by the formulae:

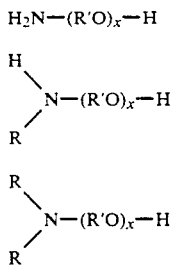

wherein x is a number from about 2 to about 15 and R and R' are as described above. R may also be a hydroxypoly(hydrocarbyloxy) group.

The polyamines may be aliphatic, cycloaliphatic, heterocyclic or aromatic. Examples of the polyamines include alkylene polyamines and heterocyclic polyamines.

Alkylene polyamines are represented by the formula

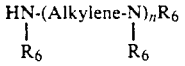

wherein n has an average value between about 1 and about 10, preferably about 2 to about 7 and the "Alkylene" group has from 1 to about 10 carbon atoms, preferably about 2 to about 6. As noted above, $R_6$ is preferably an aliphatic or hydroxy-substituted aliphatic group of up to about 30 carbon atoms.

Such alkylene polyamines include methylene polyamines, ethylene polyamines, butylene polyamines, propylene polyamines, pentylene polyamines, etc. The higher homologs and related heterocyclic amines such as piperazines and N-amino alkyl-substituted piperazines are also included. Specific examples of such polyamines are ethylene diamine, triethylene tetramine, tris-(2-aminoethyl)amine, propylene diamine, trimethylene diamine, tripropylene tetramine, tetraethylene pentamine, hexaethylene heptamine, pentaethylenehexamine, etc.

Higher homologs obtained by condensing two or more of the above-noted alkylene amines are similarly useful as are mixtures of two or more of the aforedescribed polyamines.

Ethylene polyamines, such as some of those mentioned above, are useful. Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. Ethylene polyamine mixtures are useful.

Polyamine analogs of the hydroxy monoamines, particularly alkoxylated alkylene polyamines (e.g., N,N-(diethanol)-ethylene diamine) can also be used. Such polyamines can be made by reacting alkylene amines (e.g., ethylenediamine) with one or more alkylene oxides (e.g., ethylene oxide, octadecene oxide) of two to about 20 carbons. Similar alkylene oxide-alkanol amine reaction products can also be used such as the products made by reacting the aforedescribed primary, secondary or tertiary alkanol amines with ethylene, propylene or higher epoxides in a 1:1 to 1:2 molar ratio. Reactant ratios and temperatures for carrying out such reactions are known to those skilled in the art.

Specific examples of alkoxylated alkylene polyamines include N-(2-hydroxyethyl) ethylene diamine, N,N-bis(2-hydroxyethyl)-ethylene-diamine, 1-(2-hydroxyethyl)piperazine, mono(hydroxypropyl)-substituted tetraethylene pentamine, N-(3-hydroxybutyl)-tetramethylene diamine, etc. Higher homologs obtained by condensation of the above-illustrated hydroxyalkylene polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

Among the heterocyclic polyamines are aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine.

Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

The ammonium salts of the acids represented by Formula (I) or (II) may be prepared from ammonia or mono- or polyamines. These salts are usually prepared at a temperature of from about 30° C. to about 110° C., with about 30° C. to about 80° C. being preferred.

When the collector is a metal salt, the metal salt of the acids represented by Formula I, II, III or IV may be prepared by the reaction of the acid with an alkali, an alkaline earth or transition metal compound. The metal compounds are usually in the form of metal oxides, hydroxides, carbonates, sulfates, etc. Examples of metal compounds include sodium hydroxide or oxide, potassium hydroxide or oxide, calcium hydroxide or carbonate, zinc oxide or hydroxide, manganese oxide or hydroxide, magnesium oxide or hydroxide etc. The reaction usually occurs at a temperature of from about 30° C. to about 150° C., with about 30° C. to about 125° C. being preferred. The acid is reacted with the metal compound in roughly stoichiometric amounts. It should be noted that a slight excess of metal-containing compound may be used.

Preferably, the metals of the metal containing compound may be sodium, potassium, calcium, magnesium, manganese or zinc. Zinc is a highly preferred metal.

The following examples are provided so as to provide those of ordinary skill in the art with a complete disclosure and description of how to make the compounds and compositions of the invention and are not intended to limit the scope of what the inventors regard as their invention. Efforts have been made to insure accuracy with respect to numbers used (e.g. amounts, temperature, etc.) but some experimental errors and deviation should be accounted for. Unless indicated otherwise, parts are parts by weight, percentages are percent by weight, temperature is in degrees C, and pressure is at or near atmospheric. Neutralization number is the amount in the milligrams of potassium hydroxide or hydrochloric acid required to neutralize one gram of sample.

EXAMPLE 1

To a suitable vessel is added 852 parts (2 equivalents) of di-2-ethylhexyl dithiophosphoric acid, 300 parts isopropyl alcohol, and 300 parts methylamyl alcohol to a vessel. Then, 2-acrylamido-2-methyl-propane sulfonic acid (414 parts, 2 equivalents) is added to the vessel. The reaction mixture is heated to 80° C. to 90° C. for three hours. The reaction mixture is cooled to 40° C. and the product is decanted. The product has a neutralization acid number of 60.8. The product has a percent nitrogen of 1.45; a percent sulfur of 11.15; and a percent phosphorus of 3.81.

EXAMPLE 2

Following the same procedure as Example 1, 957 parts (3 equivalents) of isopropyl, methylamyldithiophosphoric acid, 300 parts of isopropyl alcohol, 400 parts of methylamyl alcohol, and 621 parts (3 equivalents) of 2-acrylamido-2-methyl propane sulfonic acid are added to a suitable vessel and reacted to produce a product. This product has a neutralization number of 75.2 with a percent nitrogen of 1.78; percent sulfur of 12.94; and a percent phosphorus of 4.24.

EXAMPLE 3

Following the same procedure as Example 1, 463 parts (1.6 equivalents) of isobutyl, amyldithiophosphoric acid zinc salt, 649 parts of isopropyl alcohol, 683 parts of methyl alcohol, and 173 parts (1.6 equivalents) of vinyl sulfonic acid are added to a suitable vessel and reacted to produce a product.

EXAMPLE 4

A reaction product is prepared following the same procedure as Example 1, except that 463 parts (1.6 equivalents) of isobutyl, amyl dithiophosphoric acid zinc salt, 649 parts of isopropyl alcohol, 683 parts of methyl alcohol, and 295 parts (1.6 equivalents) of styrene sulfonic acid are used.

EXAMPLE 5

To a suitable vessel is added 366 parts (1.25 equivalents) of isobutyl, amyl dithiophosphoric acid zinc salt having a phosphorus content of 10.4% and which is oil free, 508 parts of isopropyl alcohol, and 539 parts of methyl alcohol to a vessel. 2-acrylamido-2methyl propane sulfonic acid (259 parts, 1.25 equivalents) is added portionwise over 30 minutes. The mixture is heated to 70° C. to 80° C. and held until an infrared spectrum shows no absorbance bands at approximately 6.2 to about 6.25 microns which correspond to the vinyl group. The reaction is cooled to 40° and filtered through paper. The product shows no vinyl group absorbence signals according to infrared spectroscopy (IR) and has a neutralization number of 1.7. The product also contains approximately 40% nonvolatiles and have specific gravity of 0.93 at 25° C.

EXAMPLE 6

Following the same procedure as Example 5, 210 parts (0.5 equivalents) of di(2-ethylhexyl)dithiophosphoric acid zinc salt which has a phosphorus content of 7.39%, 400 ml of isopropyl alcohol and 83 ml of distilled water are added to a suitable vessel. To this mixture is added 103 parts (0.5 equivalents) of 2-acrylamido-2-methylpropane sulfonic acid. The product has a neutralization number of approximately 9 and a percent nitrogen of 2.2, a percent sulfur of 15.3, a percent phosphorus of 5.0 and a percent zinc of 5.4.

EXAMPLE 7

Following the same procedure as Example 5, 298 parts (0.5 equivalents) of a di$C_{12-14}$ dithiophosphoric acid zinc salt, having a phosphorus content of 5.2% and a neutralization number of 10.2, 450 ml of isopropyl alcohol, and 90 ml of water are added to a suitable vessel. To this mixture is added 104 parts (0.5 equivalents) of 2-acrylamido-2-methylpropane sulfonic acid. After elimination of the vinyl group as measured by IR, the product has a neutralization number of 19.4, percent nitrogen of 1.5, percent sulfur of 11.8, percent phosphorus of 3.95, and a percent zinc of 3.7.

EXAMPLE 8

Following the same procedure as Example 5, 100 parts (0.32 equivalents) of a dimethylamyldithiophosphoric acid zinc salt which has: a percent phosphorus of 10.0; a percent sulfur of 19.5; a percent zinc of 12.2; and is oil free, 50 ml of methyl alcohol, 450 ml of isopropyl alcohol, and 25 ml of distilled water are added to a suitable vessel. Then, 67 parts (0.32 equivalents) of 2-acrylamido-2-methylpropane sulfonic acid are added portionwise. After elimination of the vinyl band as measured by IR, the product has a percent nitrogen of 1.09, a percent sulfur of 4.95, a percent phosphorus of 1.54 and a percent nonvolatiles of 27%.

EXAMPLE 9

Following the procedure of Example 5, 1192 parts (1.0 equivalent) of di(heptylphenyl)dithiophosphoric acid zinc salt which has a percent phosphorus equal to 2.6, percent sulfur equal to 5.2 and is 50% by weight in xylene, 125 parts of methyl alcohol are added to a suitable vessel. Then 207 parts (1.0 equivalent) of 2-acrylamido-2-methylpropane sulfonic acid are added. After elimination of the IR band corresponding to the vinyl group, the product has a neutralization number of 7.9, percent nitrogen of 1.23, percent sulfur of 6.2, and a percent phosphorus of 2.18.

EXAMPLE 10

To a suitable vessel is added 190 parts (0.28 equivalents) of a di($C_{14}$-18) dithiophosphoric acid having a neutralization number of 82.1, 380 ml of a 50:50 mixture of isobutyl alcohol and amyl alcohol to a vessel. Then 57.6 parts (0.28 equivalents) of 2-acrylamido-2-methylpropane sulfonic acid is added portionwise over 8 minutes. The mixture is heated to 80° C. and held until elimination of the vinyl absorbance band according to IR. Then, 43 parts of triethanolamine is added and the reaction temperature is maintained at 80° C. to 90° C. for 4.5 hours. The reaction product is filtered through diatomaceous earth to yield the product. The product has a neutralization acid number of 58.3, a percent nitrogen of 2.4, a percent phosphorus of 3.1, and a percent sulfur of 8.5.

EXAMPLE 11

To a suitable vessel is added 467 parts (0.5 equivalents) of the product of Example 1 and 45 parts (0.5 equivalents) of 2-amino-2-methyl-1-propanol. The temperature is raised by the exothermic reaction. When the exothermic reaction ceases and the reaction temperature begins to fall, the reaction is filtered to yield the reaction product. Reaction product has an acid number of 56.8, a percent nitrogen of 2.66, a percent sulfur of 10.20, and a percent phosphorus of 3.48.

EXAMPLE 12

To a suitable vessel is added 374 parts (0.5 equivalents) of the product of Example 2 to a vessel. Then, 8.5 parts (0.5 equivalents) of ammonia gas is added through a precision bore over 2 hours. The temperature is allowed to rise to 35°. Nitrogen gas is bubbled through the reaction at one standard cubic foot per hour to remove excess ammonia. The product has a neutralization number of 74.1, percent nitrogen of 3.60, percent sulfur of 12.37, and a percent phosphorus of 3.80.

The amount of the collector of the present invention included in the slurry to be used in the flotation process is an amount which is effective in promoting the froth flotation process and providing improved separation of the desired mineral values. The amount of collector of the present invention included in the slurry will depend upon a number of factors including the nature and type of ore, size of ore particles, etc. In general, from about 0.001 (0.0005) to about 1 (0.5) pound (kilogram) of collector is used per ton (metric ton) of ore, preferably 0.002 (0.001) to about 0.1 (0.05), more preferably 0.003 (0.002) to about 0.08 (0.04).

In the process of the present invention, the mixture from step (A) may contain a water-soluble inorganic base in addition to the ore, water and collector. The inclusion of a base is well known in the art for providing desirable pH values. Desirable pH values are about 8 and above, preferably about 8 to about 13, more preferably about 9 to about 12, with about 10 to about 12 being highly preferred. Alkali and alkaline earth metal oxides and hydroxides are useful inorganic bases. Lime is a particularly useful base. In the process of the present invention, it has been discovered that the addition of a base to the ore or slurry containing the collectors of this invention results in a significant increase in the copper assay of the cleaner concentrates.

The mixtures used in this invention will contain from about 20% to about 50% by weight of solids, and more generally from about 30% to 40% solids. Such slurries can be prepared by mixing all the above ingredients. Alternatively, the collector and inorganic base can be premixed with the ore either as the ore is being ground or after the ore has been ground to the desired particle size. Thus, in one embodiment, the ground pulp is prepared by grinding the ore in the presence of collector and inorganic base and this ground pulp is thereafter diluted with water to form the slurry. The amount of inorganic base included in the ground ore and/or the slurry prepared from the ore is an amount which is sufficient to provide the desired pH to the slurry. Generally, the amount of inorganic base is from about 0.5 (0.25) to about 4 (2.0), preferably from about 0.75 (0.38) to about 3 (1.5), pounds (kilograms) per ton (metric ton) of ore. This amount may be varied by one skilled in the art depending on particular preferences.

In step (B), the slurry may be subjected to a froth flotation to recover most of the copper values in the froth (concentrate) while rejecting significant quantities of undesirable minerals and gangue in the underflow. The flotation stage of the flotation system, as schematically illustrated in the figure, comprises at least one flotation stage wherein a rougher concentrate is recovered, and/or one or more cleaning stages wherein the rougher concentrate is cleaned and upgraded. Tailing products from each of the stages can be routed to other stages for additional mineral recovery.

The copper rougher flotation stage will contain at least one frother, and the amount of frother added will be dependent upon the desired froth characteristics which can be selected with ease by one skilled in the art. A typical range of frother addition is from about 0.04 (0.02) to about 0.1 (0.05) pound (kilogram) of frother per ton (metric ton) of dry ore.

A wide variety of frothing agents have been used successfully in the flotation of minerals from base metal sulfide ores, and any of the known frothing agents can be used in the process of the present invention. By way of illustration, such frothing agents as straight or branched chain low molecular weight hydrocarbon alcohols such as $C_{6-8}$ alkanols, 2-ethylhexanol and 4-methyl-2-pentanol (also known as methylisobutylcarbinol, MIBC) may be employed as well as pine oils, cresylic acid, polyglycol or monoethers of polyglycols and alcohol ethoxylates.

An essential ingredient of the slurry contained in the copper rougher stage is one or more of the collectors described above. In one embodiment, the collector is included in the slurry in step (B), and additional collector may be added during the flotation steps including the rougher stage as well as the cleaner stage. In addition to the collectors of the present invention, other types of collectors normally used in the flotation of sulfide ores can be used. The use of such auxiliary collectors in combination with the collectors of this invention often results in improved and superior recovery of more concentrated copper values. These auxiliary collectors also may be added either to the rougher stage or the cleaning stage, or both.

As noted above, the froth flotation step can be improved by the inclusion of auxiliary collectors in addition to the collectors of the present invention. The most common auxiliary collectors are hydrocarbon compounds which contain anionic or cationic polar groups. Examples include the fatty acids, the fatty acid soaps, xanthates, xanthate esters, xanthogen formates, thionocarbamates, dithiocarbamates, fatty sulfates, fatty sulfonates, mercaptans, thioureas, dialkyldithiophosphates and dialkyldithiophosphinates. The xanthates and thionocarbamates are particularly useful auxiliary collectors.

One group of xanthate collectors which has been utilized in froth flotation processes may be represented by the formula $$R_7—O—C(=S)SM$$

wherein $R_7$ is an alkyl group containing from 1 to 6 carbon atoms and M is a dissociating cation such as sodium or potassium. Examples of such xanthates include potassium amyl xanthate, sodium amyl xanthate, etc.

The thionocarbamates useful as auxiliary collectors include the dialkylthionocarbamates represented by the formula $$R_8OC(=S)NHR_9$$

wherein $R_8$ and $R_9$ are alkyl groups. U.S. Pat. Nos. 2,691,635 and 3,907,854 describe processes for preparing dialkylthionocarbamates as represented by the above formula. These two patents are incorporated by reference herein for their disclosures of the methods of preparing suitable auxiliary collectors useful in this invention.

Hydrocarboxycarbonyl thionocarbamate compounds also have been reported as useful collectors for beneficiating sulfide ores. The hydrocarboxycarbonyl thionocarbamate compounds are represented by the formula $$R_{10}OC(=O)N(H)C(=S)OR_{11}$$

wherein $R_{10}$ and $R_{11}$ are each independently selected from saturated and unsaturated hydrocarbyl groups, alkyl polyether groups and aromatic groups. The preparation of these hydrocarboxycarbonyl thionocarbamic compounds and their use as collectors is described in U.S. Pat. No. 4,584,097, the disclosure of which is hereby incorporated by reference. Specific examples of auxiliary collectors which may be utilized in combination with the collectors of the present invention include: sodium isopropyl xanthate, isopropyl ethyl thionocarbamate, N-ethoxycarbonyl N'-isopropylthiourea, etc.

In the flotation step (B), the slurry is frothed for a period of time which maximizes copper recovery. The precise length of time is determined by the nature and particle size of the ore as well as other factors, and the time necessary for each individual ore can be readily determined by one skilled in the art. Typically, the froth flotation step is conducted for a period of from 2 to about 20 minutes and more generally from a period of about 5 to about 15 minutes. As the flotation step proceeds, small amounts of collectors may be added periodically to improve the flotation of the desired mineral values. Additional amounts of the collector of the present invention may be added periodically to the rougher concentrate and included in the slurry. In one preferred embodiment, the collectors present during the froth flotation comprise a mixture of one or more of the phosphorodithioic acid salts of the invention with one or more xanthate or thionocarbamate.

When the froth flotation has been conducted for the desired period of time, the copper rougher concentrate is collected, and the copper rougher tailing product is removed and may be subjected to further purification.

The recovered copper rougher concentrate is processed further to improve the copper grade and reduce the impurities within the concentrate. One or more cleaner flotation stages can be employed to improve the copper grade to a very satisfactory level without unduly reducing the overall copper recovery of the system. Generally, two cleaner flotation stages have been found to provide satisfactory results.

Prior to cleaning, however, the copper rougher concentrate is finely reground to reduce the particle size to a desirable level. In one embodiment, the particle size is reduced so that 60% is less than 400 mesh (35 microns). The entire copper rougher concentrate can be comminuted to the required particle size or the rougher concentrate can be classified and only the oversized materials comminuted to the required particle size. The copper rougher concentrate can be classified by well-known means such as hydrocyclones. The particles larger than desired are reground to the proper size and are recombined with the remaining fraction.

The reground copper rougher concentrate then is cleaned in a conventional way by forming an aqueous slurry of the reground copper rougher concentrate in water. One or more frothers and one or more collectors are added to the slurry which is then subjected to a froth flotation. The collector utilized in this cleaner stage may be one or more of the collectors of the present invention and/or any of the auxiliary collectors described above. In some applications, the addition of collector and a frother to the cleaning stage may not be necessary if sufficient quantities of the reagents have been carried along with the concentrate from the preceding copper rougher flotation. The duration of the first copper cleaner flotation is a period of from about 5 to about 20 minutes, and more generally for about 8 to about 15 minutes. At the end of the cleaning stage, the froth containing the copper cleaner concentrate is recovered and the underflow which contains the copper cleaner tailings is removed. In one preferred embodiment, the copper cleaner concentrate recovered in this manner is subjected to a second cleaning stage and which the requirements for collector and frother, as well as the length of time during which the flotation is carried out to obtain a highly satisfactory copper content and recovery can be readily determined by one skilled in the art.

In another embodiment, the slurry from step (A) is subjected to conditioning. The conditioning acts to suppress iron while enhancing copper recovery. After the embodiments described above, it is useful in some of the embodiments described above, it is useful in some flotation procedures to condition the slurry with sulfur dioxide under aeration at a pH of from about 5.5 to about 7.5. The conditioning medium may be an aqueous solution formed by dissolving sulfur dioxide in water forming sulfurous acid ($H_2SO_3$) It has been found that when certain ore slurries are conditioned with sulfurous acid and aerated, the $SO_2$ increases the flotation rate of copper minerals, and depresses the undesired gangue and undesirable minerals such as iron resulting in the recovery in subsequent treatment stages of a product that represents a surprising high recovery of copper values and a surprising low retention of iron. The amount of sulfur dioxide added to the slurry in the conditioning step can be varied over a wide range, and the precise amounts useful for a particular ore or flotation process can be readily determined by one skilled in the art. In general, the amount of sulfur dioxide utilized in the conditioning step is within the range of from about 1 (0.5) to about 10 (5) pounds (kilograms) of sulfur dioxide per ton (metric ton) of ground ore. The pH of the conditioned slurry should be maintained between about 5.5 and about 7.5, more preferably between about 6.0 to about 7.0. A pH of about 6.5 to about 7.0 is particularly preferred for the conditioned slurry.

Conditioning of the slurry is achieved by agitating the pulp contained in a conditioning tank such as by vigorous aeration and optionally, with a suitable agitator such as a motor-driven impeller, to provide good solid-liquid contact between the finely divided ore and the sulfurous acid. The pulp is conditioned sufficiently long to maximize depression of the undesirable minerals and gangue while maximizing activation of the desired minerals such as copper minerals. Thus, conditioning time will vary from ore to ore, but it has been found for the ores tested that conditioning times of between about 1 to 10 minutes and more generally from about 3 to 7 minutes provide adequate depression of the undesirable minerals and gangue.

One of the advantages of the conditioning step is that it allows recovery of a concentrate having very satisfactory copper content without requiring the introduction of lime, cyanide or other conditioning agents to the flotation circuit, although as mentioned above, the introduction of some lime frequently improves the results obtained. Omitting these other conditioning agents, or reducing the amounts of lime or other conditioning agents offers relief for both the additional costs and the environmental and safety factors presented by these agents. However, as noted below, certain advantages are obtained when small amounts of such agents are utilized in the flotation steps.

Flotation of copper is effected in the copper rougher stage at a slightly acidic pulp pH which is generally between about 6.0 and 7.0, the pH being governed by the quantity of sulfur dioxide used during the conditioning and aeration as well as the quantity of any inorganic base included in the slurry.

When the process of the present invention is carried out on copper sulfide ores, and in particular, copper sulfide ores from the Southwest of the United States of America, cleaned copper concentrates are found to contain high concentrations of copper with improved recoveries.

The following examples illustrate the process of the present invention. Unless otherwise indicated in the examples and otherwise in the specification and claims, all parts and percentages are by weight, and temperatures are in degrees Centrigrade. Also in the following examples, the amount of reagents added are expressed in "pounds per ton of dry ore" ("kilograms per metric ton"). It is meant to cover the pounds (kilograms) of reagent per ton (metric ton) of fresh dry ore, which is ground, slurried and fed to a froth flotation system. The ores of the Southwest United States of America used in the following examples are Ore 1, assaying an average of about 0.255% by weight copper and about 0.013% by weight molybdenum; and Ore 2, assaying an average of about 0.32% by weight copper and 0.03% by weight molybdenum. The ores are crushed to pass ten mesh (1000 microns), and ground to 30% passing 100 mesh (110 microns).

EXAMPLE I

Calcium hydroxide (1 (0.5) pound (kilogram) per ton (metric ton)) is added to Ore 1 and the mixture is ground at 60% solids in water for 8 minutes. The pulp has a pH of approximately 9.9. The product of Example 5 (0.04 (0.02)) and C-400, a molybdenum collector which is a blend of aromatic oil and sulfur based chemicals from Phillips Petroleum Company, (0.01 (0.005)) are added to the pulp. Oreprep f-547, a mixture of ethylisobutylcarbinol (0.014 (0.007)) is then added. Air is blown into the slurry to produce a froth and the froth is collected for 3 minutes. More Oreprep f-547 (0.021 (0.01) pounds (kilograms) per ton (metric ton)) is added and froth is collected for three minutes.

The concentrate contains 6.23% copper and 0.779% molybdenum which reflects a recovery of 93.9% for copper and 93.8% for molybdenum.

EXAMPLE II

The product of Example 5 (0.007 (0.004) pound kilogram) per ton (metric ton)); Phillips MCO, a nonpolar molybdenum collector, (0.04 (0.02)); potassium ethyl xanthate (0.005 (0.002)); MIBC, methylisobutylcarbinol (0.05 (0.02)); calcium hydroxide (2.0 (1.0)) are added to Ore 2 and the mixture is diluted with water to 60% solids. The slurry is ground for 13 minutes. The slurry has a pH of approximately 11.3. Air is introduced into the slurry to form a froth. The froth is collected for two minutes. Froth collection is repeated for 2 minutes. More MIBC (0.005 (0.002)) is added and froth is collected for two minutes.

The concentrate has 10.9% copper and 1.58% molybdenum, which reflects a recovery of 92.4% for copper and 93.8% for molybdenum.

As can be seen by the above examples, the products of the present invention provide effective copper and molybdenum recovery.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A mineral recovery process comprising the steps of:

(A) forming a slurry of at least one crushed mineral-containing ore, water and at least one collector for said mineral which is an acid, or an anhydride, ester, ammonium salt or metal salt of the acid that is represented by the formula (I)

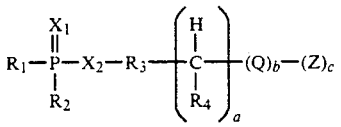

or (II)

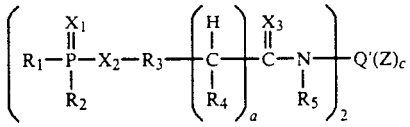

wherein each $R_1$ and $R_2$ is independently a hydrocarbyl or hydrocarbylthio group;

each $X_1$ and $X_2$ is independently sulfur or oxygen;

$R_3$ is a divalent hydrocarbyl group, each $R_4$ and $R_5$ is independently a hydrogen or hydrocarbyl group;

a is 0 or 1;

b is 0 or 1;

c is 1 or 2;

Q is a divalent, trivalent or tetravalent hydrocarbyl group or $—C(X_3)NR_5Q'$;

$X_3$ is sulfur or oxygen;

Q' is a divalent, trivalent or tetravalent hydrocarbyl group provided Q' is not divalent in Formula II;

Z is —S(O)OH, or $—S(O)_2OH$.

(B) subjecting the slurry from step (A) to froth flotation to produce a froth containing said mineral; and (C) recovering said mineral from the froth.

2. The process of claim 1, wherein the collector is represented by Formula (I).

3. The process of claim 2, wherein each $R_1$ and $R_2$ is independently a hydrocarbyl or hydrocarbyloxy group having from 1 to about 30 carbon atoms; wherein $X_1$ and $X_2$ are sulfur; wherein each $R_4$ and $R_5$ is independently hydrogen or alkyl having from 1 to about 12 carbon atoms; and wherein Q is an arylene group having from 6 to about 18 carbon atoms, an alkylene group having from 1 to about 18 carbon atoms, or $—C(X_3)NR_5Q'$; and $X_3$ is oxygen.

4. The process of claim 2, wherein each $R_1$ and $R_2$ is independently an alkoxy group containing from about 2 to about 24 carbon atoms or aryloxy groups having from 6 to about 24 carbon atoms.

5. The process of claim 1, wherein, the collector is represented by formula (I) and Q is $—C(X_3)NR_5Q'—$.

6. The process of claim 1, wherein the collector is represented by formula (II).

7. The process of claim 6, wherein each $R_1$ and $R_2$ is independently a hydrocarbyl or hydrocarbyloxy group having from 1 to about 30 carbon atoms; wherein $X_1$ and $X_2$ are sulfur; wherein each $R_4$ and $R_5$ is independently hydrogen or alkyl having from 1 to about 12 carbon atoms; and wherein Q' is a trivalent or tetralavent hydrocarbyl group having from 1 to about 18 carbon atoms; and $X_3$ is oxygen.

8. The process of claim 1, wherein the collector is an ester containing from 1 to about 40 carbon atoms in the ester group.

9. The process of claim 1, wherein the collector is an ammonium salt formed from at least one nitrogen compound selected from the group consisting of ammonia, a monoamine and a polyamine.

10. The process of claim 9, wherein the nitrogen compound is a monoamine which has from 1 to about 24 carbon atoms.

11. The process of claim 9, wherein the nitrogen compound is a polyamine.

12. The process of claim 9, wherein the polyamine is a polyalkylene polyamine.

13. The process of claim 1, wherein the collector is an acid.

14. The process of claim 1, wherein the collector is a metal salt, the metal of which is selected from the group consisting of an alkali, an alkaline earth, or a transition metal.

15. The process of claim 14, wherein the metal is selected from the group consisting of zinc, nickel, cobalt, iron, manganese, sodium, calcium, magnesium and potassium.

16. The process of claim 14, wherein the metal is zinc.

17. The process of claim 1 wherein the ore is a multiple metal containing ore.

18. The process of claim 1, wherein the ore is a copper containing ore.

19. The process of claim 1, wherein step (A) further comprises:

forming the slurry with a compound selected from the group consisting of at least one xanthate and at least one dithionocarbamate.

20. The process of claim 1, wherein step (A) further comprises:

forming the slurry with an inorganic base.

21. The process of claim 20, wherein the inorganic base is an alkali metal or alkaline earth metal oxide or hydroxide.

22. The process of claim 20, wherein the inorganic base is calcium hydroxide.

23. The process of claim 1, wherein step (A) further comprises:

conditioning the slurry with $SO_2$ until the slurry has a pH of from about 4.5 to about 7.0.

24. The process of claim 1, wherein the collector is present in an amount from about, 0.001 to about 1 pound per ton of ore.

25. A mineral recovery process comprising the steps of:

(A) forming a slurry of at least one crushed copper-containing ore, water, and at least one copper mineral collector which is an acid, or a metal salt of the acid that is represented by the formula (I)

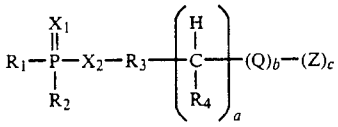

or (II)

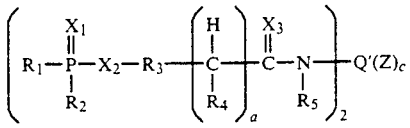

wherein each $R_1$ and $R_2$ is independently hydrocarbyl or hydrocarbyloxy or hydrocarbylthio group;

each $X_1$ and $X_2$ is independently sulfur or oxygen;

$R_3$ is a divalent hydrocarbyl groups, each $R_4$ and $R_5$ is independently hydrogen or a hydrocarbyl group;

a is 0 or 1;

b is 0 or 1;

c is 1 or 2;

Q is a divalent, trivalent or tetravalent hydrocarbyl group or $—C(X_3)NR_5Q'$;

$X_3$ is sulfur or oxygen;

Q' is a divalent, trivalent or tetravalent hydrocarbyl group provided Q' is not divalent in Formula II;

Z is —S(O)OH, or $—S(O)_2OH$.

(B) subjecting the slurrY from step (A) to froth flotation to produce a froth containing said copper mineral; and (C) recovering copper from the froth.

26. The process of claim 25, wherein each $R_1$ and $R_2$ is independently a hydrocarbyl or hydrocarbyloxy group having from 1 to about 30 carbon atoms; wherein $X_1$ and $X_2$ are sulfur; wherein each $R_4$ and $R_5$ is independently hydrogen or an alkyl having from 1 to 12 carbon atoms; and wherein Q and Q' are each independently an arylene having from 6 to 18 carbon atoms or alkylene group having from 1 to about 18 carbon atoms; and $X_3$ is oxygen.

27. The process of claim 25, wherein the collector is an acid.

28. The process of claim 27, wherein the collector is a metal salt where the metal of the metal salt is selected from the group consisting of an alkali, an alkaline earth, or a transition metal.

29. The process of claim 27, wherein the metal of the metal salt is selected from the group consisting of sodium, potassium, calcium, magnesium, manganese and zinc.

30. The process of claim 27, wherein the metal of the metal salt is zinc.

31. The process of claim 25, wherein the slurry (B) further comprises a water-soluble inorganic base.

32. The process of claim 25, wherein at least one compound selected from the group consisting of a xanthate and a dithionocarbamate collector is added to the conditioned slurry during the froth flotation step

33. The process of claim 25, wherein the collector is present in an amount from about 0.001 to about 1 pound per ton of ore.

* * * * *